US007557556B2

(12) United States Patent
Nakashimo

(10) Patent No.: US 7,557,556 B2
(45) Date of Patent: Jul. 7, 2009

(54) VOLTAGE CONTROL CIRCUIT

(75) Inventor: Takao Nakashimo, Chiba (JP)

(73) Assignee: Seiko Instruments Inc., Chiba (JP)

( * ) Notice: Subject to any disclaimer, the term of this patent is extended or adjusted under 35 U.S.C. 154(b) by 9 days.

(21) Appl. No.: 11/935,022

(22) Filed: Nov. 5, 2007

(65) Prior Publication Data

US 2008/0136398 A1 Jun. 12, 2008

(30) Foreign Application Priority Data

Nov. 6, 2006 (JP) ..... 2006-300002

(51) Int. Cl.
*G05F 5/00* (2006.01)

(52) U.S. Cl. ..... 323/299; 323/316; 323/273; 323/303; 323/282; 323/274; 323/277

(58) Field of Classification Search ..... 323/316, 323/299, 273, 303, 282, 226, 274, 277
See application file for complete search history.

(56) References Cited

U.S. PATENT DOCUMENTS 5,781,002 A * 7/1998 O'Neill ..... 323/299
6,005,378 A * 12/1999 D'Angelo et al. ..... 323/313
6,060,871 A * 5/2000 Barker ..... 323/280
6,188,211 B1 * 2/2001 Rincon-Mora et al. ..... 323/280
6,812,678 B1 * 11/2004 Brohlin ..... 323/280

FOREIGN PATENT DOCUMENTS

JP 7-74976 B 8/1995

* cited by examiner

*Primary Examiner*—Akm E Ullah
*Assistant Examiner*—Nguyen Tran
(74) *Attorney, Agent, or Firm*—Brinks Hofer Gilson & Lione

(57) ABSTRACT

Provided is a voltage control circuit which suppresses a calorific value that generates when short-circuit fault occurs even if a voltage value of an input voltage is large. At the time of short-circuit fault, an additional control voltage Va whose voltage value becomes larger when the voltage value of the input voltage Vin is larger is input to the voltage control p-channel MOS transistor (110) from a transistor control MOS transistor (160), to thereby increase resistance of the voltage control p-channel MOS transistor (110) to suppress a short-circuit current. As a result, when the input voltage Vin is larger, the current value of a holding current or a calorific value after the short-circuit protecting operation has been conducted can be suppressed.

1 Claim, 7 Drawing Sheets

VOLTAGE CONTROL CIRCUIT

This application claims priority under 35 U.S.C. §119 to Japanese Patent Application No. JP2006-300002 filed Nov. 6, 2006, the entire content of which is hereby incorporated by reference.

BACKGROUND

1. Field of the Invention

The present invention relates to a voltage control circuit which prevents a thermal damage even if a short-circuit fault occurs.

2. Background Information

A voltage control circuit (voltage regulator) is a circuit that is connected between a power supply and a fed circuit. The voltage control circuit conducts a control so as to hold a voltage value that is output from the voltage control circuit to the fed circuit constant even if a voltage value that is input from the power supply to the voltage control circuit is varied.

When this type of the voltage control circuit is incorporated into a power supply portion, it is possible to apply a voltage having a constant voltage value to the fed circuit even if an output voltage of the power supply (for example, a battery) is varied. Accordingly, a voltage control circuit of a monolithic IC is incorporated into the power supply portion of a portable device such as a cell phone, a game machine, or a notebook computer.

Now, the basic circuit configuration and operation principle of the voltage control circuit will be described with reference to FIG. 5. As shown in FIG. 5, a voltage control circuit 1 includes a voltage control p-channel MOS transistor 10, a voltage divider resistor circuit 20, and a transistor control circuit 30 as main members.

The voltage control p-channel MOS transistor 10 has an input terminal (source) connected to a voltage input terminal 11 of the voltage control circuit 1, and an output terminal (drain) connected to a voltage output terminal 12 of the voltage control circuit 1.

The voltage control p-channel MOS transistor 10 has such a characteristic that conduction resistance is increased as the voltage value of a control voltage Vc that is input to a control terminal (gate) is increased, and the conduction resistance is decreased as the voltage value of the control voltage Vc that is input to the control terminal (gate) is decreased. The "conduction resistance" means a resistance between the input terminal (source) and the output terminal (drain) obtained when the voltage control p-channel MOS transistor 10 is rendered conductive.

The voltage input terminal 11 of the voltage control circuit 1 is input with a supply voltage (input voltage) Vin from a power supply (for example, a battery). The input voltage Vin has a voltage value controlled by the voltage control p-channel MOS transistor 10, and an output voltage Vout that becomes a predetermined set voltage value is output from the voltage output terminal 12 of the voltage control circuit 1. A voltage control manner using the voltage control p-channel MOS transistor 10 will be described later.

Also, the voltage output terminal 12 is connected to a fed circuit (not shown), and a voltage that becomes the set voltage value is applied to the fed circuit.

The voltage divider resistor circuit 20 is designed so as to connect a voltage divider resistor 21 and a voltage divider resistor 22 in series. One end (high voltage end) of the voltage divider resistor circuit 20 is connected to the voltage output terminal 12, and the other end thereof (low voltage end) is connected to a ground potential.

The voltage divider resistor circuit 20 outputs a divided voltage Vp obtained by dividing the output voltage Vout which is output from the voltage output terminal 12 by the voltage divider resistors 21 and 22. The divided voltage Vp is a voltage that is applied to the voltage divider resistor 22, and is represented by the following expression when it is assumed that a resistance of the voltage divider resistor 21 is R21, and a resistance of the voltage divider resistor 22 is R22.

$$Vp=Vout\cdot[R22/(R21+R22)]$$

The transistor control circuit 30 has a differential amplifier (operational amplifier) 31 and a reference voltage source 32. A non-inverting input terminal (positive terminal) of the differential amplifier 31 is input with the divided voltage Vp, and an inverting input terminal (negative terminal) of the differential amplifier 31 is input with a reference voltage Vref that is output from the reference voltage source 32.

The differential amplifier 31 outputs the control voltage Vc according to a deviation between the divided voltage Vp and the reference voltage Vref. The control voltage Vc is input to the gate of the voltage control p-channel MOS transistor 10.

The operation principle of holding the voltage value of the output voltage Vout that is output from the voltage output terminal 12 to the set value (constant value) by the aid of the voltage control circuit (voltage regulator) 1 structured above will be described below.

For example, when the voltage value of the output voltage Vout increases beyond the set value (constant value), the voltage value of the divided voltage Vp also increases. As a result, the voltage value of the control voltage Vc increases. When the voltage value of the control voltage Vc increases, the conduction resistance of the voltage control p-channel MOS transistor 10 increases, and the output voltage Vout decreases due to the increase in the conduction resistance. Then, the voltage value of the output voltage Vout is returned to the set value (constant value).

On the contrary, for example, when the voltage value of the output voltage Vout is made lower than the set value (constant value), the voltage value of the divided voltage Vp also decreases. As a result, the voltage value of the control voltage Vc decreases. When the voltage value of the control voltage Vc decreases, the conduction resistance of the voltage control p-channel MOS transistor 10 decreases, and the output voltage Vout increases due to the decrease in the conduction resistance. Then, the voltage value of the output voltage Vout is returned to the set value (constant value).

In this way, the voltage value of the output voltage Vout is held to the set value (constant value). The set value (constant value) of the output voltage Vout is represented by the following expression.

$$Vout=Vref\cdot[(R21+R22)/R22]$$

Incidentally, when a short-circuit fault occurs in the fed circuit that is connected to the voltage output terminal 12 or the like, the voltage value of the voltage at the voltage output terminal 12 is rapidly decreased down to the voltage value of the ground potential or a voltage value close to the ground potential. When the voltage value of the voltage output terminal 12 is remarkably decreased due to the short-circuit fault in this way, the voltage value of the divided voltage Vp as well as the voltage value of the control voltage Vc is remarkably decreased. When the voltage value of the control voltage Vc is remarkably decreased, the conduction resistance of the voltage control p-channel MOS transistor 10 is remarkably decreased. As a result, a current value of the current that flows in the voltage control p-channel MOS transistor 10 is remarkably increased.

When a large current flows in the voltage control p-channel MOS transistor 10 due to the short-circuit fault as described above, a heat generation that is attributable to the large current increases, resulting in a risk that an IC package into which the voltage control circuit 1 is incorporated is thermally damaged. That is, due to the short-circuit fault, a large amount of the heat is generated beyond the permissible heat resistance capacity of the IC package, and there is a risk that the IC such as the voltage control circuit 1 is thermally damaged.

Under the circumstances, there has been developed a voltage control circuit that is added with a short-circuit protection circuit that limits a current which flows in the control MOS transistor even if the short-circuit fault occurs (for example, refer to JP 07-74976 B).

Next, a voltage control circuit (voltage regulator) 1A with the short-circuit protection circuit will be described with reference to FIG. 6. The same parts as those in FIG. 5 are denoted by identical reference numerals, and their overlapping description will be omitted.

As shown in FIG. 6, the voltage control circuit (voltage regulator) 1A further includes a monitor circuit 40, an inverter circuit 50, and a transistor control MOS transistor 60 in addition to the voltage control p-channel MOS transistor 10, the voltage divider resistor circuit 20, and the transistor control circuit 30.

The monitor circuit 40, the inverter circuit 50, and the transistor control MOS transistor 60 constitute a short-circuit protection circuit.

The monitor circuit 40 is designed so as to connect a monitor MOS transistor 41 and a monitor resistor 42 in series, and a connection point of the drain of the monitor MOS transistor 41 and the monitor resistor 42 is represented as a monitor voltage output point 43.

The monitor circuit 40 is connected in parallel to the voltage control p-channel MOS transistor 10. That is, one end (high voltage end) of the monitor circuit 40 is connected to the source of the voltage control p-channel MOS transistor 10, and the other end (low voltage end) of the monitor circuit 40 is connected to the drain of the voltage control p-channel MOS transistor 10.

The monitor MOS transistor 41 of the monitor circuit 40 has such a characteristic that the conduction resistance increases as the voltage value of the voltage that is input to the control terminal (gate) thereof increases, and the conduction resistance decreases as the voltage value of the voltage that is input to the control terminal (gate) thereof decreases.

The gate of the monitor MOS transistor 41 is connected to the output terminal of the differential amplifier 31 in the transistor control circuit 30.

Further, when the monitor MOS transistor 41 is described in comparison with the voltage control p-channel MOS transistor 10, both of the MOS transistors 10 and 41 are equal to each other in the channel length. Also, the channel width of the monitor MOS transistor 41 is smaller than the channel width of the voltage control p-channel MOS transistor 10.

In this example, when it is assumed that a division value obtained by dividing the "channel width of the voltage control p-channel MOS transistor 10" by the "channel width of the monitor MOS transistor 41" is a channel width ratio $\alpha$, the channel width ratio $\alpha$ is, for example, 100.

Accordingly, in the case where both of the MOS transistors 10 and 41 are rendered conductive, the current value of the current that flows in the monitor MOS transistor 41 is a small current value obtained by multiplying the current value of the current that flows in the voltage control p-channel MOS transistor 10 by $1/\alpha$ (for example, 1/100).

For that reason, in the case where the current that flows in the voltage control p-channel MOS transistor 10 increases or decreases, the current value of the current that flows in the monitor MOS transistor 41 also increases or decreases. Moreover, the current values of both of the MOS transistors 10 and 41 increase or decrease while keeping a proportional relationship. In other words, the current that flows in the voltage control p-channel MOS transistor 10 is scaled to $1/\alpha$ (for example, 1/100) times, and monitored by the monitor MOS transistor 41.

The inverter circuit 50 is designed so as to connect an inverter resistor 51 and an inverter MOS transistor 52 in series, and a connection point of the inverter resistor 51 and the drain of the inverter MOS transistor 52 is represented by an inverter output point 53.

The inverter circuit 50 is connected in parallel to the voltage control p-channel MOS transistor 10. In other words, one end (high voltage end) of the inverter circuit 50 is connected to the source of the voltage control p-channel MOS transistor 10, and the other end (low voltage end) of the inverter circuit 50 is connected to the drain of the voltage control p-channel MOS transistor 10.

The gate of the inverter MOS transistor 52 is connected to the monitor voltage output point 43 of the monitor circuit 40.

The transistor control MOS transistor 60 has a source connected to the voltage input terminal 11, and a drain connected to the gate of the voltage control p-channel MOS transistor 10 and the gate of the monitor MOS transistor 41. The gate of the transistor control MOS transistor 60 is connected to the inverter output point 53 of the inverter circuit 50.

The transistor control MOS transistor 60 has such a characteristic that the conduction resistance increases as the voltage value of the voltage that is input to the control terminal (gate) thereof increases, and the conduction resistance decreases as the voltage value of the voltage that is input to the control terminal (gate) thereof decreases.

In the voltage control circuit 1A thus configured, when the control voltage Vc is applied to the gate of the voltage control p-channel MOS transistor 10 and the gate of the monitor MOS transistor 41 from the transistor control circuit 30, both of the MOS transistors 10 and 41 are rendered conductive.

In a normal state where no short-circuit fault occurs, the inverter MOS transistor 52 and the transistor control MOS transistor 60 are rendered nonconductive.

In a state where the input voltage Vin is input to the voltage input terminal 11 and the fed circuit is connected to the voltage output terminal 12, when both of the MOS transistors 10 and 41 are rendered conductive, the current flows in the voltage control p-channel MOS transistor 10 and the monitor MOS transistor 41.

In this situation, when it is assumed that a current that flows in the voltage control p-channel MOS transistor 10 is i10 and a current that flows in the monitor MOS transistor 41 (monitor circuit 40) is i40, a relationship of $i10/\alpha = i40$ is established.

On the other hand, when the short-circuit fault occurs in the fed circuit that is connected to the voltage output terminal 12 or the like, the current i10 that flows in the voltage control p-channel MOS transistor 10 rapidly increases, and the current i40 that flows in the monitor MOS transistor 41 (monitor circuit 40) also rapidly increases in proportion to the current i10 as described above.

When the current that flows in the monitor circuit 40 rapidly increases, a monitor voltage Vm (voltage generated by allowing the current i40 to flow in the monitor resistor 42) which is applied to the monitor resistor 42 rapidly increases. The monitor voltage Vm is applied to the inverter MOS transistor 52 through the monitor voltage output point 43. For that reason, when the monitor voltage Vm exceeds a threshold voltage Vt of the inverter MOS transistor 52, the inverter MOS transistor 52 is rendered conductive.

When the inverter MOS transistor 52 is rendered conductive as described above, the potential of the inverter output point 53 changes from the high potential (potential equivalent to the potential of the voltage input terminal 11) to the low potential (potential equivalent to the potential (ground potential) of the voltage output terminal 12).

When the potential of the inverter output point 53 changes (inverts) from the high potential to the low potential, the potential that is input to the gate of the transistor control MOS transistor 60 also changes from the high potential to the low potential, and the conduction resistance of the transistor control MOS transistor 60 is decreased.

When the conduction resistance of the transistor control MOS transistor 60 becomes low, the transistor control MOS transistor 60 adjusts the voltage value of the input voltage Vin that has been input to the source according to the value of the conduction resistance, and outputs an additional control voltage Va whose voltage value has been adjusted from the drain. The additional control voltage Va is input to the gate of the voltage control p-channel MOS transistor 10.

Consequently, when the short-circuit fault occurs, the gate of the voltage control p-channel MOS transistor 10 is applied with not only the control voltage Vc that has been output from the transistor control circuit 30, but also the additional control voltage Va that has been output from the transistor control MOS transistor 60.

As described above, the voltage control p-channel MOS transistor 10 is applied with not only the control voltage Vc but also the additional control voltage Va, so the conduction resistance of the voltage control p-channel MOS transistor 10 rapidly increases. Because the conduction resistance of the voltage control p-channel MOS transistor 10 rapidly increases, the current i10 that flows in the voltage control p-channel MOS transistor 10 is also rapidly suppressed, and the current value of the current i10 is decreased.

As a result, even if the short-circuit fault occurs, the current value of the current that flows in the voltage control p-channel MOS transistor 10 can be suppressed, thereby preventing the thermal damage from occurring due to the short-circuit current.

FIG. 7 is a characteristic diagram showing a relationship between the current that flows in the voltage control p-channel MOS transistor 10 (an output current that is output from the voltage output terminal 12) and the output voltage Vout that is output from the voltage output terminal 12 in the voltage control circuit 1A added with the short-circuit protection circuit.

As shown in FIG. 7, when the output voltage Vout is decreased, the output current is also decreased with the decreased voltage in a state where the output current is the maximum current Im. Then, when the output voltage Vout becomes zero, that is, when the voltage output terminal 12 is short-circuited to the ground potential, the output current becomes a holding current Is.

The voltage-current characteristic shown in FIG. 7 is called "fold-back drooping characteristic" because of its shape.

Because the source potential (the potential of the voltage output terminal 12) of the inverter MOS transistor 52 is different from the ground potential, the "Fold-back drooping characteristic" is produced by varying the threshold voltage of the inverter MOS transistor 52 due to the back gate effect.

In this example, when it is assumed that the threshold voltage of the inverter MOS transistor 52 is Vt, the variation of the threshold voltage due to the back gate effect is ΔVt, and the resistance of the monitor resistor 42 is R42, the maximum current Im and the holding current Is are represented by the following expressions, respectively.

$$Im=(Vt+\Delta Vt)/R42$$

$$Is=Vt/R42$$

In the case where a short-circuit fault occurs, the conventional voltage control circuit 1A shown in FIG. 6 controls the resistance of the voltage control p-channel MOS transistor 10 to be larger, to thereby suppress the current value of the current that flows in the voltage control circuit 1A (the current that flows in the voltage control p-channel MOS transistor 10). More specifically, the current value of the current that flows in the voltage control circuit 1A when the short-circuit fault occurs (the current that flows in the voltage control p-channel MOS transistor 10) becomes a current value indicated by the holding current Is.

For that reason, in the case where the short-circuit fault continues, heat corresponding to an electric power represented by the following expression (1) continues to generate in the voltage control circuit 1A.

$$[\text{Input Voltage Vin}]\times[\text{Holding current Is}] \quad (1)$$

Moreover, the current value of the holding current Is in the embodiment shown in FIG. 6 is fixed to a predetermined current value (refer to FIG. 7).

Incidentally, the voltage control circuit is used in diverse industrial fields (for example, a field such as an on-vehicle regulator or a large-current regulator), and the voltage value of the input voltage that is input to the voltage input terminal of the voltage control circuit becomes large depending on an applied industrial field.

In the case where the voltage value of the input voltage that is input to the voltage control circuit is large, even if the current value of the current that flows in the voltage control circuit is suppressed to the current value indicated by the holding current Is, the generated voltage (Vin×Is) is increased, and the calorific value of the IC package into which the voltage control circuit has been incorporated becomes large as is apparent from the expression (1).

However, the permissible heat resistant capacity per se of the IC package is not changed as it was.

As a result, in the case where the voltage value of the input voltage that is input to the voltage control circuit is large, there is a risk that heat that exceeds the permissible heat resistant capacity of the IC package is generated, and the IC of the voltage control circuit or the like is thermally damaged.

SUMMARY OF THE INVENTION

The present invention has been made in view of the above prior art, and therefore an object of the present invention is to provide a voltage control circuit that has high reliability and is capable of preventing thermal damage by suppressing heat generated at the time of a short-circuit fault even if a voltage value of an input voltage which is input to the voltage control circuit is large.

In order to solve the above problem, according to an aspect of the present invention, there is provided a voltage control circuit including:

- a voltage control MOS transistor having an input terminal connected to a voltage input terminal and an output terminal connected to a voltage output terminal;
- transistor control means for detecting a voltage value of an output voltage that is output from the voltage output terminal and controlling a voltage value of a control voltage that is applied to a control terminal of the voltage control MOS transistor so that the voltage value of the output voltage becomes a predetermined set voltage value;

a transistor control MOS transistor having an input terminal connected to the voltage input terminal and an output terminal connected to the control terminal of the voltage control MOS transistor, which applies an additional control voltage that increases conduction resistance of the voltage control MOS transistor to the control terminal of the voltage control MOS transistor when a voltage of the control terminal changes from a high potential to a low potential;

a monitor circuit having a monitor MOS transistor and a monitor resistor that is a variable resistor which are connected in series, which is connected in parallel to the voltage control MOS transistor;

an inverter circuit having an input terminal input with a monitor voltage that is applied to the monitor resistor, and an output terminal whose voltage changes from a high potential to a low potential when the monitor voltage exceeds a predetermined threshold value; and a voltage detecting and resistance adjusting unit that detects the voltage value of an input voltage that is input to the voltage input terminal, increases resistance of the monitor resistor when the voltage value of the input voltage increases, and decreases the resistance of the monitor resistor when the voltage value of the input voltage decreases.

According to another aspect of the present invention, there is provided a voltage control circuit including:

a voltage control MOS transistor having an input terminal connected to a voltage input terminal and an output terminal connected to a voltage output terminal;

transistor control means for detecting a voltage value of an output voltage that is output from the voltage output terminal and controlling a voltage value of a control voltage that is applied to a control terminal of the voltage control MOS transistor so that the voltage value of the output voltage becomes a predetermined set voltage value;

a transistor control MOS transistor having an input terminal connected to the voltage input terminal and an output terminal connected to the control terminal of the voltage control MOS transistor, which applies an additional control voltage that increases conduction resistance of the voltage control MOS transistor to the control terminal of the voltage control MOS transistor when a voltage of the control terminal changes from a high potential to a low potential;

a monitor circuit having a monitor MOS transistor and a monitor resistor whose resistance is fixed which are connected in series, which is connected in parallel to the voltage control MOS transistor;

an inverter circuit having an input terminal input with a monitor voltage that is applied to the monitor resistor, and an output terminal whose voltage changes from a high potential to a low potential when the monitor voltage exceeds a predetermined threshold value; and a current mirror circuit including an input voltage conversion resistor that is electrically connected between the voltage input terminal and a ground potential, a second current mirror transistor that is connected in series with the input voltage conversion resistor and allows a current that flows in the input voltage conversion resistor to flow therein, and a first current mirror transistor that allows a current which flows in the second current mirror transistor to flow in the monitor resistor.

In the present invention, the conduction resistance of the voltage control MOS transistor is adjusted in such a manner that the voltage value of the output voltage becomes the set voltage value even if the voltage value of the input voltage is varied. Also, the short-circuit protecting operation that increases the conduction resistance of the voltage control MOS transistor more than usual is conducted at the time of the short-circuit fault. As a result, the short-circuit current that flows at the time of short-circuit is suppressed. Moreover, the short-circuit protecting operation starts in a state where the short-circuit current value is smaller when the voltage value of the input voltage is larger.

As a result, the value of the current (holding current) that flows in the voltage control circuit after the short-circuit protecting operation becomes smaller when the voltage value of the input voltage is larger. For that reason, even in the case where the input voltage is large, it is possible to suppress the calorific value (=input voltage×holding current) that generates at the time of short-circuit, the thermal damage is not caused, and the reliability of the product is improved.

DETAILED DESCRIPTION OF THE PREFERRED EMBODIMENTS

Figure 1:
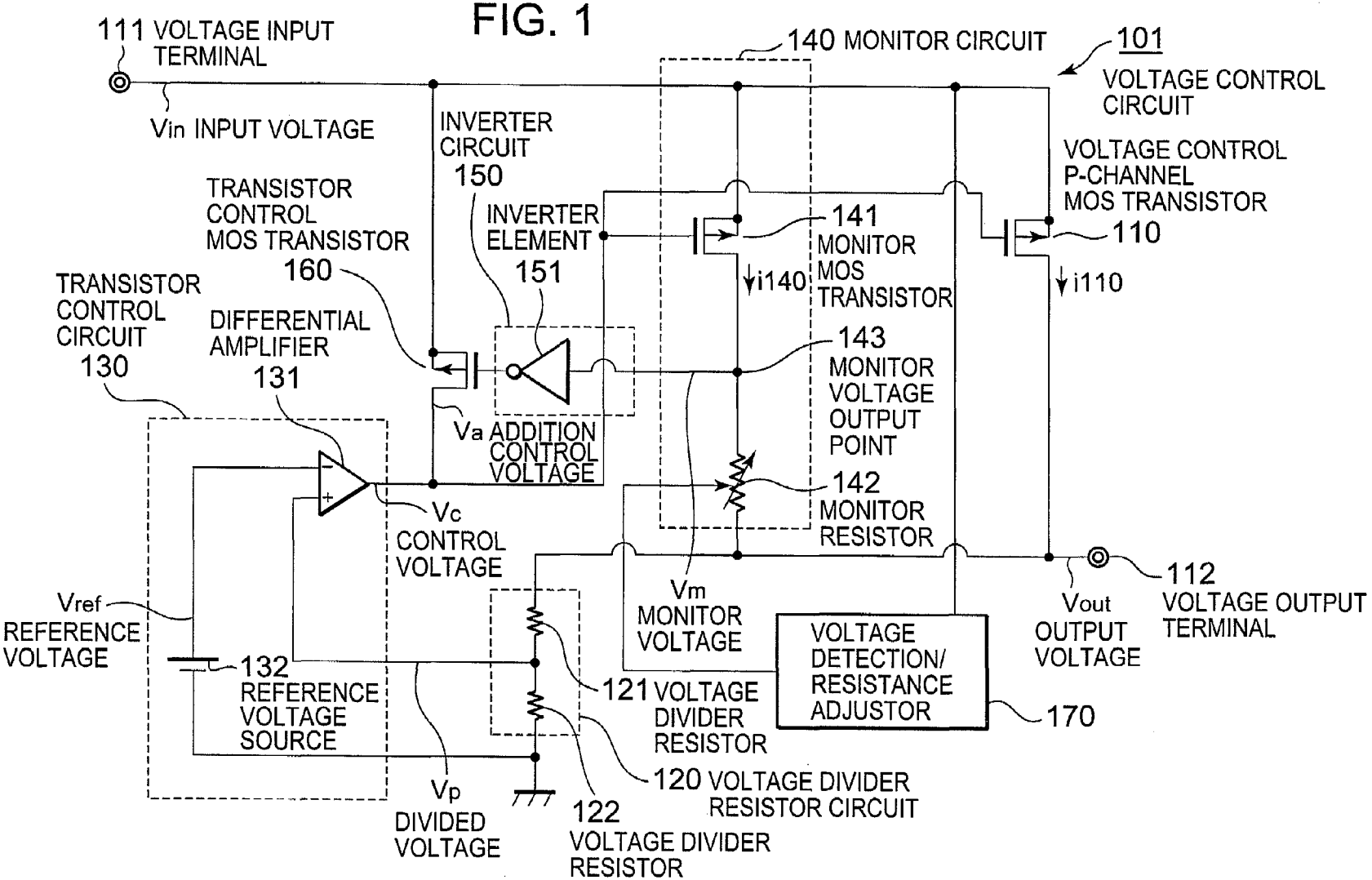
FIG. 1 is a circuit diagram showing a voltage control circuit according to a first embodiment of the present invention.

Hereinafter, best modes for carrying out the present invention will be described in detail on the basis of embodiments.

First Embodiment (Circuit Configuration of First Embodiment)

A voltage control circuit (voltage regulator) 101 according to a first embodiment of the present invention will be described with reference to FIG. 1. The voltage control circuit 101 is a monolithic IC circuit, which includes a voltage control p-channel MOS transistor 110, a voltage divider resistor circuit 120, a transistor control circuit 130, a monitor circuit 140, an inverter circuit 150, a transistor control MOS transistor 160, and a voltage detecting and resistance adjusting unit 170 as main members.

The voltage divider resistor circuit 120 and the transistor control circuit 130 constitute transistor control means for controlling a voltage value of a control voltage Vc that is applied to the voltage control p-channel MOS transistor 110.

The voltage control p-channel MOS transistor 110 has an input terminal (source) connected to a voltage input terminal 111 of the voltage control circuit 101, and an output terminal (drain) connected to a voltage output terminal 112 of the voltage control circuit 101.

The voltage control p-channel MOS transistor 110 has such a characteristic that conduction resistance increases as the voltage value of the control voltage that is input to the control terminal (gate) thereof increases, and conduction resistance decreases as the voltage value of the control voltage that is input to the control terminal (gate) thereof decreases.

The voltage input terminal 111 of the voltage control circuit 101 is input with a supply voltage (input voltage) Vin from a power supply (for example, a battery). The input voltage Vin has a voltage value controlled by the voltage control p-channel MOS transistor 110, and an output voltage Vout that becomes a predetermined set voltage value is output from the voltage output terminal 112 of the voltage control circuit 101.

Also, the voltage output terminal 112 is connected with a fed circuit (not shown), and a voltage that becomes the set voltage value is applied to the fed circuit.

The voltage divider resistor circuit 120 is so designed as to connect a voltage divider resistor 121 and a voltage divider resistor 122 in series. One end (high voltage end) of the voltage divider resistor circuit 120 is connected to the voltage output terminal 112, and the other end thereof (low voltage end) is connected to a ground potential.

The voltage divider resistor circuit 120 outputs a divided voltage Vp obtained by dividing the output voltage Vout which is output from the voltage output terminal 112 by the voltage divider resistors 121 and 122. The divided voltage Vp is a voltage that is applied to the voltage divider resistor 122, and is represented by the following expression when it is assumed that a resistance of the voltage divider resistor 121 is R121, and a resistance of the voltage divider resistor 122 is R122.

$$Vp = V\text{out} \cdot [R122/(R121+R122)]$$

The transistor control circuit 130 has a differential amplifier (operational amplifier) 131 and a reference voltage source 132. A non-inverting input terminal (positive terminal) of the differential amplifier 131 is input with the divided voltage Vp, and an inverting input terminal (negative terminal) of the differential amplifier 131 is input with a reference voltage Vref that is output from the reference voltage source 132.

The differential amplifier 131 outputs the control voltage Vc according to a deviation between the divided voltage Vp and the reference voltage Vref. The control voltage Vc is input to the gate of the voltage control p-channel MOS transistor 110.

The monitor circuit 140 is so designed as to connect a monitor MOS transistor 141 and a monitor resistor 142 that is a variable resistor in series, and a connection point of a drain of the monitor MOS transistor 141 and the monitor resistor 142 are denoted by a monitor voltage output point 143.

The monitor circuit 140 is connected in parallel to the voltage control p-channel MOS transistor 110. That is, one end (high voltage end) of the monitor circuit 140 is connected to the source of the voltage control p-channel MOS transistor 110, and the other end (low voltage end) of the monitor circuit 140 is connected to the drain of the voltage control p-channel MOS transistor 110.

The monitor MOS transistor 141 of the monitor circuit 140 has such a characteristic that conduction resistance increases as the voltage value of the voltage that is input to the control terminal (gate) thereof increases, and conduction resistance decreases as the voltage value of the voltage that is input to the control terminal (gate) thereof decreases.

The gate of the monitor MOS transistor 141 is connected to the output terminal of the differential amplifier 131 of the transistor control circuit 130.

Further, when the monitor MOS transistor 141 will be described as compared with the voltage control p-channel MOS transistor 110, both of the MOS transistors 110 and 141 are equal to each other in the channel length. Also, the channel width of the monitor MOS transistor 141 is smaller than the channel width of the voltage control p-channel MOS transistor 110.

In this example, when it is assumed that a division value obtained by dividing the "channel width of the voltage control p-channel MOS transistor 110" by the "channel width of the monitor MOS transistor 141" is a channel width ratio $\alpha$, the channel width ratio $\alpha$ is, for example, 100.

Accordingly, in the case where both of the MOS transistors 110 and 141 are rendered conductive, the current value of the current that flows in the monitor MOS transistor 141 is a small current value obtained by multiplying the current value of the current that flows in the voltage control p-channel MOS transistor 110 by $1/\alpha$ (for example, 1/100).

For that reason, in the case where the current that flows in the voltage control p-channel MOS transistor 110 increases or decreases, the current value of the current that flows in the monitor MOS transistor 141 also increases or decreases. Moreover, the current values of both of the MOS transistors 110 and 141 increase or decrease while keeping a proportional relationship therebetween. In other words, the current that flows in the voltage control p-channel MOS transistor 110 is scaled to $1/\alpha$ (for example, 1/100) times, and monitored by the monitor MOS transistor 141.

The inverter circuit 150 is so designed as to connect an inverter resistor 151.

Figure 6:
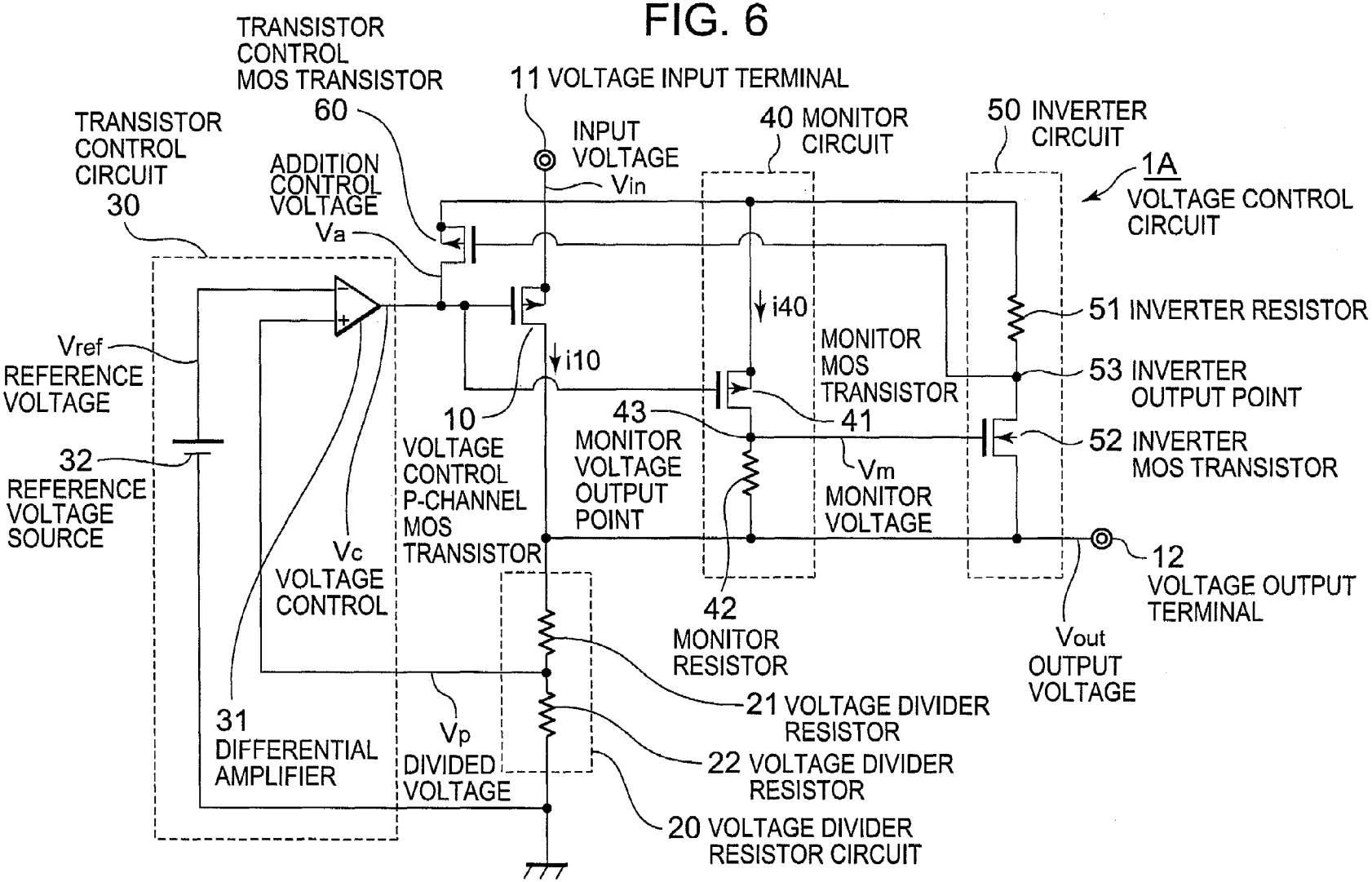
FIG. 6 is a circuit diagram showing a conventional voltage control circuit.
Figure 7:
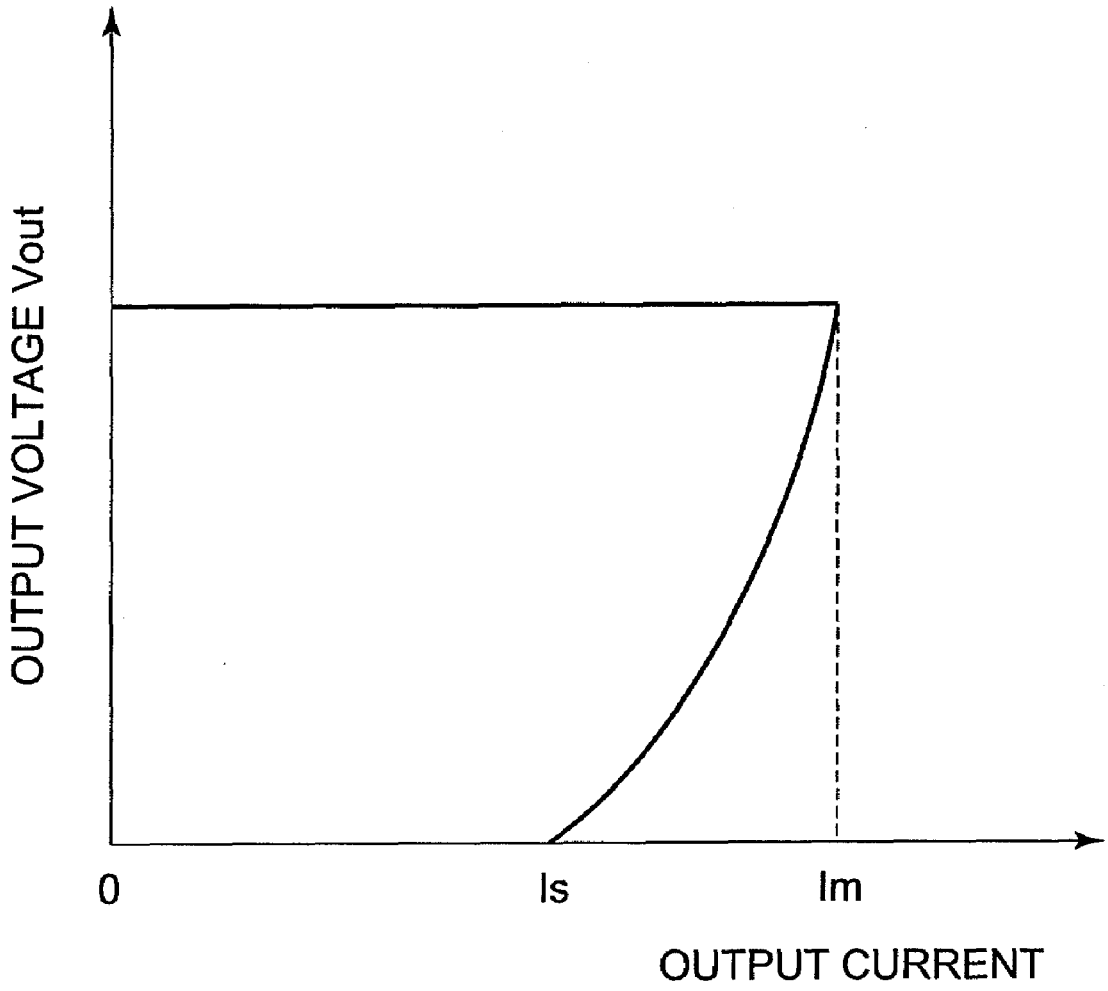
FIG. 7 is a characteristic diagram showing a relationship between an output current and an output voltage in the related art.

Alternatively, the inverter circuit 150 can be so configured as to connect an inverter resistor and an inverter MOS transistor in series as shown in FIG. 6.

An input terminal of the inverter circuit 150 (inverter element 151) is connected to the monitor voltage output point 143, and an output terminal of the inverter circuit 150 (inverter element 151) is connected to a gate of the transistor control MOS transistor 160.

The inverter element 151 is set with a threshold voltage Vt, and when the voltage at the input end of the inverter element 151 exceeds the threshold voltage Vt, the potential at the output end of the inverter element 151 changes from the high potential to the low potential.

The transistor control MOS transistor 160 has a source connected to the voltage input terminal 111, and a drain connected to the gate of the voltage control p-channel MOS transistor 110 and the gate of the monitor MOS transistor 141.

The transistor control MOS transistor 160 has such a characteristic that conduction resistance increases as the voltage value of the voltage that is input to the control terminal (gate) thereof increases, and conduction resistance decreases as the voltage value of the voltage that is input to the control terminal (gate) thereof decreases.

The voltage detecting and resistance adjusting unit 170 detects the voltage value of the input voltage Vin that is input to the voltage input terminal 111, and adjusts the resistance of the monitor resistor 142 that is a variable resistor according to the voltage value of the input voltage Vin.

Figure 2:
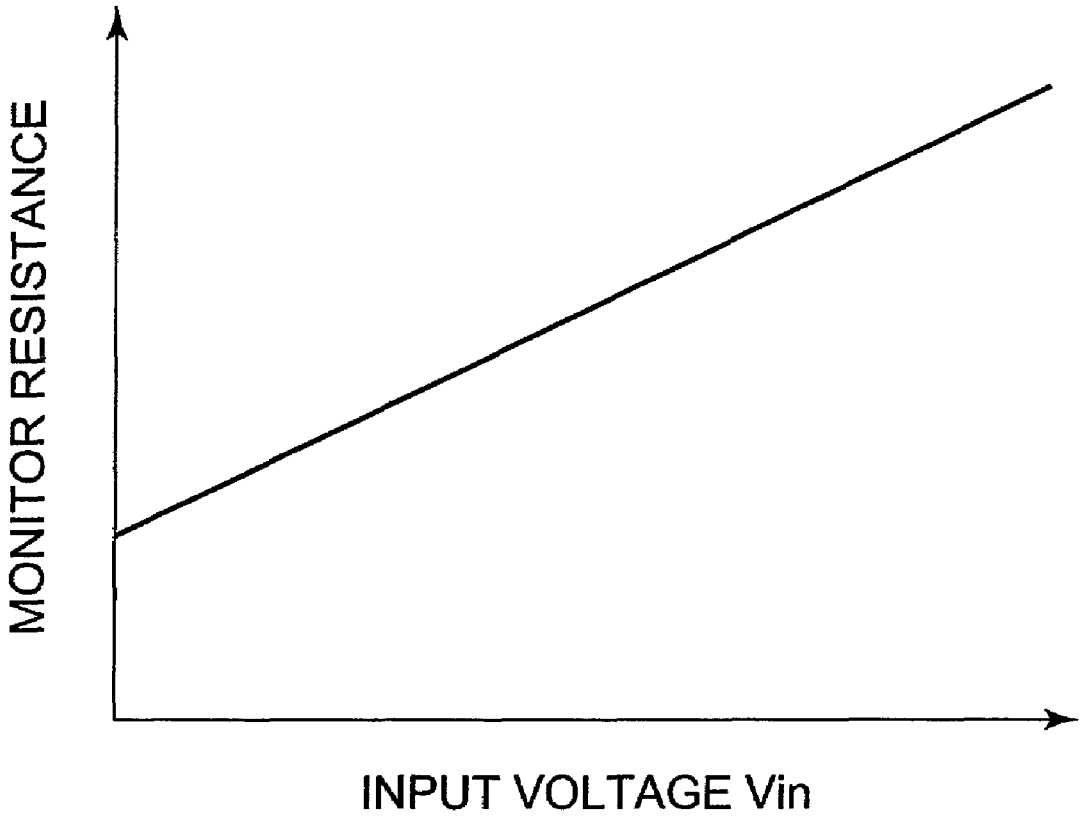
FIG. 2 is a characteristic diagram showing a resistance control characteristic of a voltage detecting and resistance adjusting unit.

For example, as shown in FIG. 2, the voltage detecting and resistance adjusting unit 170 increases the resistance of the monitor resistor 142 when the voltage value of the input voltage Vin is larger, and decreases the resistance of the monitor resistor 142 when the voltage value of the input voltage Vin is smaller.

(Operation in Stationary State)

Subsequently, a description will be given of the operation in the stationary state (state where no short-circuit fault occurs) of the voltage control circuit 101 thus configured.

When the control voltage Vc is applied to the gate of the voltage control p-channel MOS transistor 110 and the gate of the monitor MOS transistor 141 from the transistor control circuit 130, both of the MOS transistors 110 and 141 are rendered conductive.

In the usual state where no short-circuit fault occurs, the transistor control MOS transistor 160 is rendered nonconductive.

In a state where the input voltage Vin is input to the voltage input terminal 111, and the fed circuit is connected to the voltage output terminal 112, when both of the MOS transistors 110 and 141 are rendered conductive, a current flows in the voltage control p-channel MOS transistor 110 and the monitor MOS transistor 141.

In this situation, when it is assumed that the current that flows in the voltage control p-channel MOS transistor 110 is i110, and the current that flows in the monitor MOS transistor 141 (monitor circuit 140) is i140, a relationship of i110/$\alpha$=i140 is satisfied.

Now, a description will be given of the operation of holding the voltage value of the output voltage Vout that is output from the voltage output terminal 112 of the voltage control circuit 101 to the set value (constant value).

For example, when the voltage value of the output voltage Vout increases beyond the set value (constant value), the voltage value of the divided voltage Vp also increases. As a result, the voltage value of the control voltage Vc increases. When the voltage value of the control voltage Vc increases, conduction resistance of the voltage control p-channel MOS transistor 110 increases, and the output voltage Vout decreases due to an increase in the conduction resistance. Then, the voltage value of the output voltage Vout returns to the set value (constant value).

On the contrary, for example, when the voltage value of the output voltage Vout becomes lower than the set value (constant value), the voltage value of the divided voltage Vp also decreases. As a result, the voltage value of the control voltage Vc decreases. When the voltage value of the control voltage Vc decreases, conduction resistance of the voltage control p-channel MOS transistor 10 decreases, and the output voltage Vout increases due to a decrease in the conduction resistance. Then, the voltage value of the output voltage Vout returns to the set value (constant value).

In this way, the voltage value of the output voltage Vout is held to the set value (constant value). The set value (constant value) of the output voltage Vout is represented by the following expression. R121 denotes the resistance of the voltage divider resistor 121, and R122 is the resistance of the voltage divider resistor 122.

$$Vout=Vref\cdot[(R121+R122)/R122]$$

(Operation when Short-Circuit Fault Occurs)

Subsequently, the operation when the short-circuit fault occurs in the voltage control circuit 101 will be described.

When the short-circuit fault occurs in the fed circuit that is connected to the voltage output terminal 112 or the like, the current i110 that flows in the voltage control p-channel MOS transistor 110 rapidly increases, and the current i140 that flows in the monitor MOS transistor 141 (monitor circuit 140) also rapidly increases in proportion to the current i110 as in the related art described above.

When the current that flows in the monitor circuit 140 rapidly increases, a monitor voltage Vm (voltage developed by allowing the current i140 to flow in the monitor resistor 142) which is applied to the monitor resistor 142 rapidly increases. The voltage value of the monitor voltage Vm becomes larger when the resistance of the monitor resistor 142 that is a variable resistor is larger, and smaller when the resistance of the monitor resistor 142 is smaller even if the current value of the current i140 is identical.

In this embodiment, the voltage detecting and resistance adjusting unit 170 controls the resistance so as to make the resistance of the monitor resistor 142 larger when the voltage value of the input voltage Vin is larger, and make the resistance of the monitor resistor 142 smaller when the voltage value of the input voltage Vin is smaller.

Accordingly, because the resistance of the monitor resistor 142 is smaller when the voltage value of the input voltage Vin is smaller, the voltage value of the monitor voltage Vm becomes larger than the threshold voltage Vt of the inverter element 151 under the conditions where the current value of the current i110 as well as the current value of the current i140 increases beyond a certain value.

On the other hand, when the voltage value of the input voltage Vin is larger, the resistance of the monitor resistor 142 is larger. For that reason, even if the current value of the current i110 as well as the current value of the current i140 is not so increased, the voltage value of the monitor voltage Vm becomes larger than the threshold voltage Vt of the inverter element 151.

That is, the voltage value of the monitor voltage Vm exceeds the threshold voltage Vt of the inverter element 151 in a state where the current value of the current i110 as well as the current value of the current i140 is smaller when the voltage value of the input voltage Vin is larger.

When the voltage value of the monitor voltage Vm becomes larger than the threshold voltage Vt of the inverter element 151, the potential at the output terminal of the inverter element 151 changes from a high potential to a low potential.

As described above, when the potential at the output terminal of the inverter terminal 151 changes (inverts) from a high potential to a low potential, the potential that is input to the gate of the transistor control MOS transistor 160 also changes from a high potential to a low potential, and the conduction resistance of the transistor control MOS transistor 160 becomes lower.

When the conduction resistance of the transistor control MOS transistor 160 becomes lower, the MOS transistor 160 adjusts the voltage value of the input voltage Vin that has been input to the source according to the resistance of the conduction resistor, and outputs an additional control voltage Va whose voltage value has been adjusted from the drain. The additional control voltage Va is input to the gate of the voltage control p-channel MOS transistor 10.

Consequently, not only the control voltage Vc that has been output from the transistor control circuit 130, but also the additional control voltage Va that has been output from the transistor control MOS transistor 160 is applied to the gate of the voltage control p-channel MOS transistor 110 when the short-circuit fault occurs.

As described above, because not only the control voltage Vc but also the additional control voltage Va is applied to the voltage control p-channel MOS transistor 110, the conduction resistance of the voltage control p-channel MOS transistor 110 rapidly increases. Because the conduction resistance of the voltage control p-channel MOS transistor 110 rapidly increases, the current i110 that flows in the voltage control p-channel MOS transistor 110 is also rapidly suppressed, and the current value of the current i100 decreases.

As a result, even if the short-circuit fault occurs, the current value of the current that flows in the voltage control p-channel MOS transistor 110 can be suppressed, thereby preventing the thermal damage from occurring due to the short-circuit current.

Moreover, the voltage value of the monitor voltage Vm exceeds the threshold voltage Vt of the inverter element 151 in a state where the current value of the current i110 as well as the current value of the current i140 is smaller when the voltage value of the input voltage Vin is larger, and control starts to suppress the current i110 that flows in the voltage control p-channel MOS transistor 110.

Accordingly, the holding current Is is decreased when the voltage value of the input voltage Vin is larger.

Figure 3:
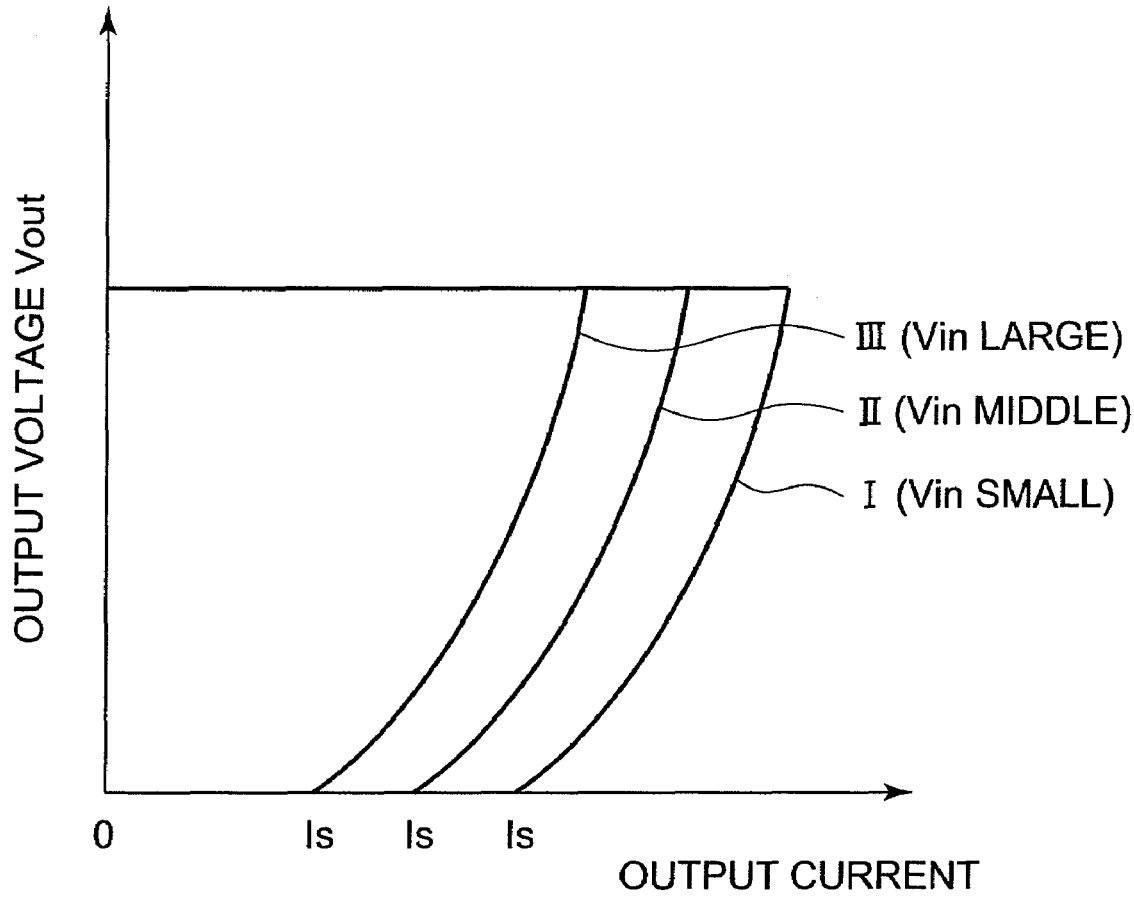
FIG. 3 is a characteristic diagram showing a relationship between an output current and an output voltage according to the first embodiment of the present invention.

FIG. 3 is a characteristic diagram showing a relationship between a current that flows in the voltage control p-channel MOS transistor 110 (output current that is output from the voltage output terminal 112) and an output voltage Vout that is output from the voltage output terminal 112 in the voltage control circuit 101.

Referring to FIG. 3, a characteristic curve I exhibits "Fold-back drooping characteristic" when the voltage value of the input voltage Vin is "small," and a characteristic II exhibits "Fold-back drooping characteristic" when the voltage value of the input voltage Vin is "medium." A characteristic III exhibits "Fold-back drooping characteristic" when the voltage value of the input voltage Vin is "large."

FIG. 3 shows only three "Fold-back drooping characteristics", and the "Fold-back drooping characteristic" is shifted according to a change in the voltage value of the input voltage Vin. In the description of FIG. 3, as the voltage value of the input voltage Vin increases, the "Fold-back drooping characteristic" is gradually shifted toward the left side, and the holding current Is is gradually decreased.

As is apparent from FIG. 3, the holding current Is becomes smaller when the input voltage Vin is larger.

In a case where the short-circuit fault continues, a heat corresponding to the electric power indicated by the following expression (2) is generated in the voltage control circuit 101.

$$[\text{Input Voltage Vin}]\times[\text{Holding Current Is}] \quad (2)$$

In this embodiment, because the holding current Is becomes smaller when the input voltage Vin is larger, even if the input voltage Vin is larger, the electric power value indicated by the expression (2) does not largely change as compared with a case in which the input voltage Vin is smaller.

Accordingly, even if the input voltage Vin that is input to the voltage input terminal 111 becomes larger, the calorific value of the voltage control circuit 101 at the time of short-circuit fault does not exceed the permissible heat resistant capacity of the IC package into which the voltage control circuit 101 has been incorporated.

As a result, even if the voltage control circuit 101 according to the first embodiment of the present invention is used as a voltage regulator for a high voltage, no thermal damage occurs at the time of short-circuit, and the reliability of the product is enhanced.

Second Embodiment (Circuit Configuration of Second Embodiment)

Figure 4:
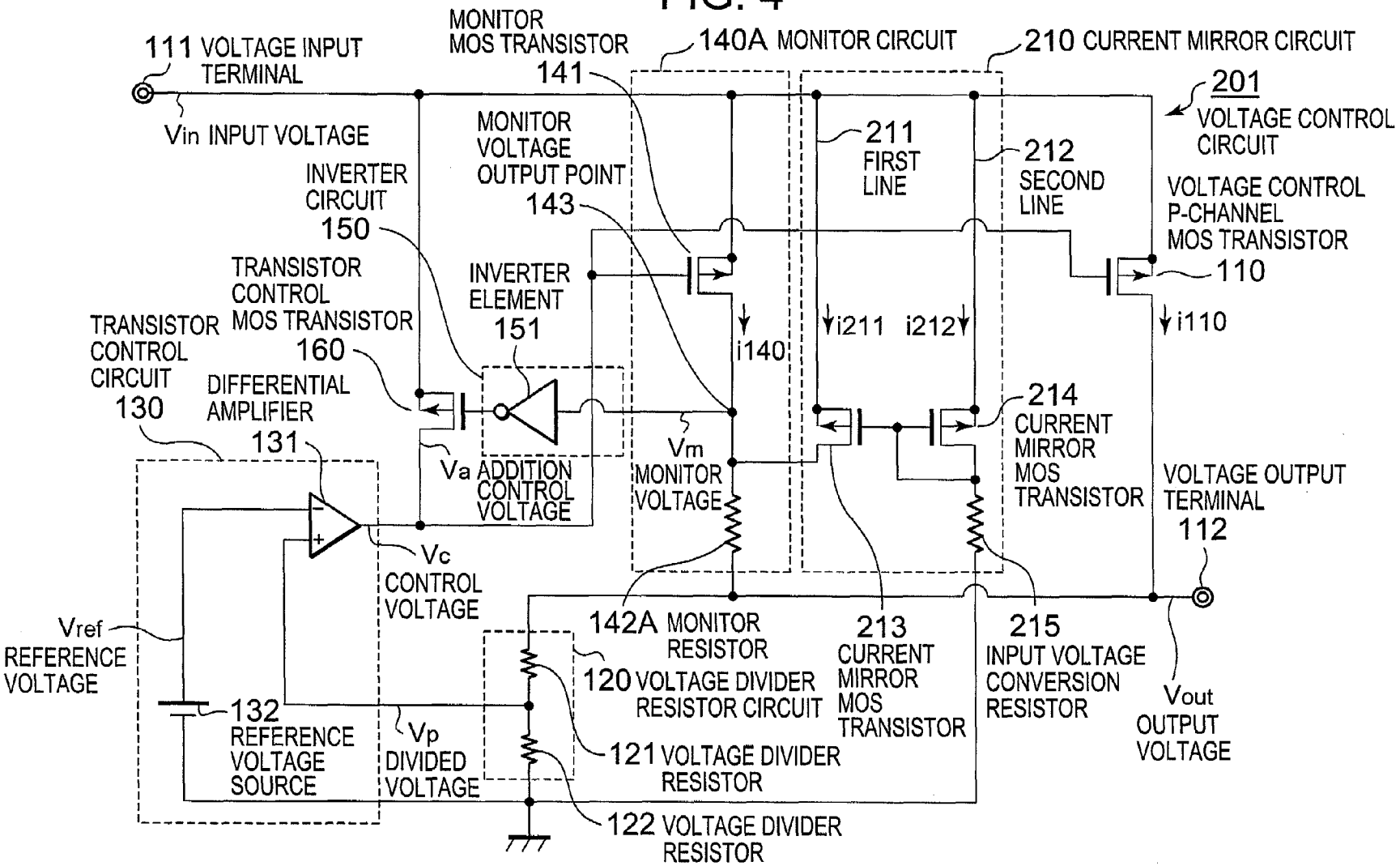
FIG. 4 is a circuit diagram showing a voltage control circuit according to a second embodiment of the present invention.
Figure 5:
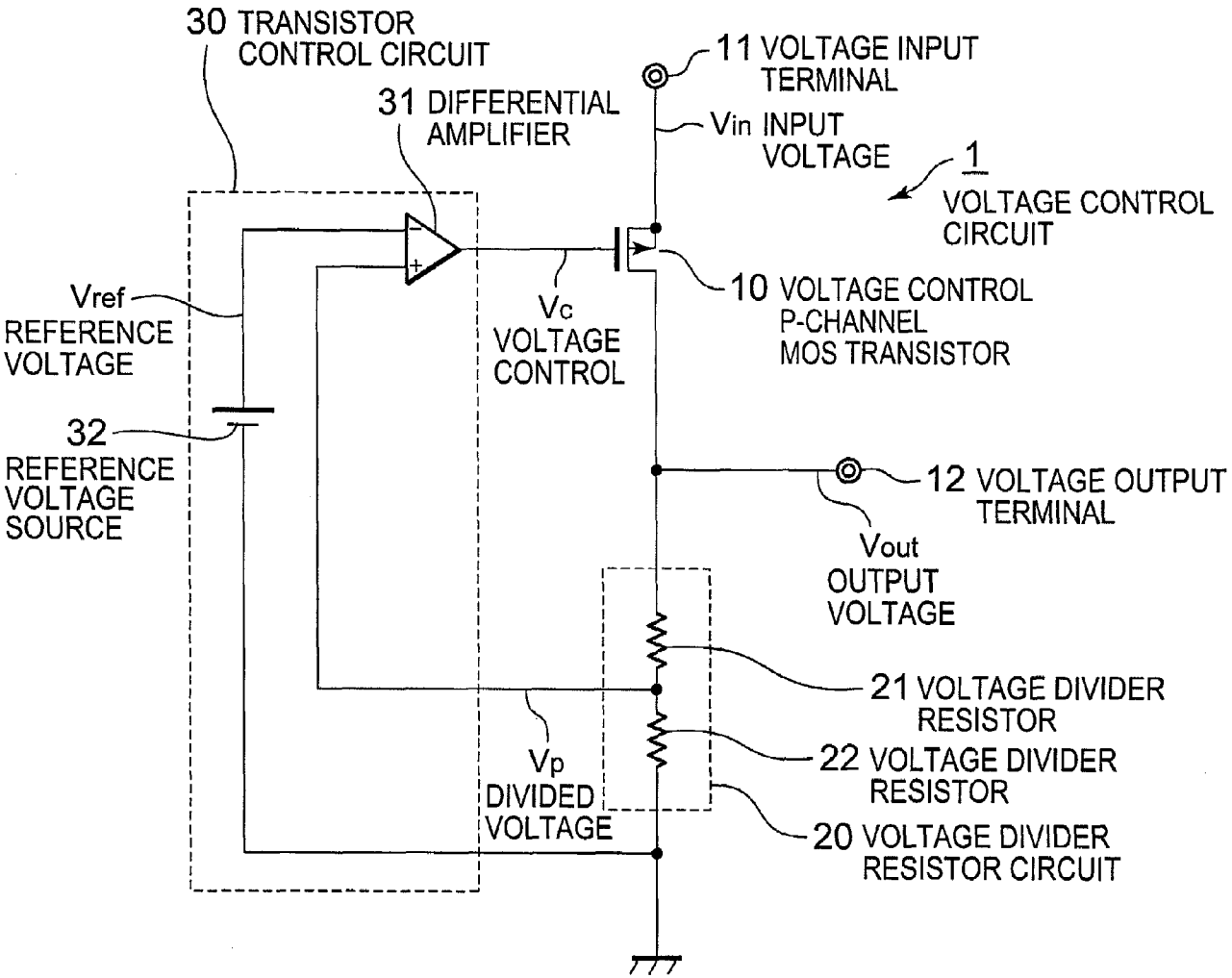
FIG. 5 is a circuit diagram showing the basic configuration of the voltage control circuit.

A voltage control circuit 201 according to a second embodiment of the present invention will be described with reference to FIG. 4. The parts having the same functions as those of the first embodiment shown in FIG. 1 are denoted by identical symbols, and the duplex description will be omitted.

The voltage control circuit 201 is a monolithic IC circuit, which includes the voltage control p-channel MOS transistor 110, the voltage divider resistor circuit 120, the transistor control circuit 130, a monitor circuit 140A, the inverter circuit 150, and a current mirror circuit 210 as main members.

The monitor circuit 140A is so configured as to connect the monitor MOS transistor 141 and a monitor resistor 142A that is a fixed resistor in series, and a connection point of the drain of the monitor MOS transistor 141 and the monitor resistor 142A is denoted as a monitor voltage output point 143.

The current mirror circuit 210 has a first line 211 and a second line 212. A current mirror MOS transistor 213 is disposed on the first line 211, and a series circuit of a current mirror MOS transistor 214 and an input voltage conversion resistor 215 is disposed on the second line 213.

A gate of the current mirror MOS transistor 213 and a gate of the current mirror MOS transistor 214 are connected to each other. Also, the gate and the drain of the current mirror MOS transistor 214 are connected to each other.

The first line 211 of the current mirror circuit 210 has one end (high potential end) connected to a voltage input terminal 111, and the other end (low potential end) connected to the monitor voltage output point 143.

The second line 212 of the current mirror circuit 210 has one end (high potential end) connected to a voltage input terminal 111, and the other end (low potential end) grounded to the ground potential.

In the current mirror circuit 210, the resistance value of the input voltage conversion resistor 215 is set to be large so that the current value of a current i212 that flows in the second line 212 becomes small. Also, the current value of a current i211 that flows in the first line 211 is larger than the current value of the current i212 that flows in the second line 212, and the current value of a current i211 that flows in the first line 211 is in proportion to the current value of the current i212 that flows in the second line 212.

The current i211 that is output from the other end (low voltage end) of the first line 211 flows in the monitor resistor 142A.

The configuration of other parts is identical with that of the first embodiment shown in FIG. 1.

(Operation when Short-Circuit Fault Occurs)

Subsequently, a description will be given of the operation of the voltage control circuit 201 thus configured when the short-circuit fault occurs.

When a short-circuit fault occurs in a fed circuit that is connected to the voltage output terminal 112, the current i110 that flows in the voltage control p-channel MOS transistor 110 rapidly increases as in the above prior art. In proportion to the increased current i110, a current i140 that flows in the monitor MOS transistor 141 (monitor circuit 140A) also rapidly increases.

Also, the current value of the current i212 that flows in the second line 212 of the current mirror circuit 210 rapidly increases, with which the current value of the current i211 that flows in the first line 211 also rapidly increases.

Moreover, the current values of the current i211 and the current i212 become larger when the voltage value of the input voltage Vin is larger.

When the current values of a current i140 and the current i211 which flow in the monitor resistor 142A rapidly increase, a monitor voltage Vm that is applied to the monitor resistor 142A (voltage that is developed by allowing the current i140 and the current i211 to flow in the monitor resistor 142A) rapidly increases.

In this case, because the current value of the current i211 becomes larger when the voltage value of the input voltage Vin is larger, the rate of increase of the monitor voltage Vm becomes larger when the voltage value of the input voltage Vin is larger.

Accordingly, because the current i211 is smaller when the voltage value of the input voltage Vin is smaller, the voltage value of the monitor voltage Vm becomes larger than the threshold voltage Vt of the inverter element 151 under the condition where the current value of the current i110 as well as the current value of the current i140 increases beyond a certain value.

On the other hand, because the current i211 is larger when the voltage value of the input voltage Vin is larger, the voltage value of the monitor voltage Vm becomes larger than the threshold voltage Vt of the inverter element 151 even if the current value of the current i110 as well as the current value of the current i140 does not so increase.

That is, the voltage value of the monitor voltage Vm exceeds the threshold voltage Vt of the inverter element 151 in a state where the current value of the current i110 as well as the current value of the current i140 is smaller when the voltage value of the input voltage Vin is larger.

When the voltage value of the monitor voltage Vm is larger than the threshold voltage Vt of the inverter element 151, the potential at the output terminal of the inverter element 151 changes from a high potential to a low potential.

In this way, when the potential at the output terminal of the inverter element 151 changes (reverses) from a high potential to a low potential, the potential that is input to the gate of the transistor control MOS transistor 160 also changes from a high potential to a low potential, and the conduction resistance of the transistor control MOS transistor 160 is decreased.

When the conduction resistance of the transistor control MOS transistor 160 is decreased, the MOS transistor 160 adjusts the voltage value of the input voltage Vin that has been input to the source according to the resistance value of the conduction resistor, and outputs the additional control voltage Va whose voltage value has been adjusted from the drain. The additional control voltage Va is input to the gate of the voltage control p-channel MOS transistor 110.

Consequently, not only the control voltage Vc that has been output from the transistor control circuit 130, but also the additional control voltage Va that has been output from the transistor control MOS transistor 160 is applied to the gate of the voltage control p-channel MOS transistor 110 when the short-circuit fault occurs.

As described above, because not only the control voltage Vc but also the additional control voltage Va is applied to the voltage control p-channel MOS transistor 110, the conduction resistance of the voltage control p-channel MOS transistor 110 rapidly increases. Because the conduction resistance of the voltage control p-channel MOS transistor 110 rapidly increases, the current i110 that flows in the voltage control p-channel MOS transistor 110 is also rapidly suppressed, and the current value of the current i100 is decreased.

As a result, even if the short-circuit fault occurs, the current value of the current that flows in the voltage control p-channel MOS transistor 110 can be suppressed, thereby preventing the thermal damage from occurring due to the short-circuit current.

Moreover, the voltage value of the monitor voltage Vm exceeds the threshold voltage Vt of the inverter element 151 in a state where the current value of the current i110 as well as the current value of the current i140 is smaller when the voltage value of the input voltage Vin is larger, and control starts to suppress the current i110 that flows in the voltage control p-channel MOS transistor 110.

Accordingly, the holding current Is is decreased when the voltage value of the input voltage Vin is larger.

In this embodiment, because the holding current Is becomes smaller when the input voltage Vin is larger, even if the input voltage Vin is larger, the electric power value indicated by the above expression (2) does not largely change as compared with a case in which the input voltage Vin is smaller.

Accordingly, even if the input voltage Vin that is input to the voltage input terminal 111 becomes larger, the calorific value of the voltage control circuit 201 at the time of short-circuit fault does not exceed the permissible heat resistant capacity of the IC package into which the voltage control circuit 201 has been incorporated.

As a result, even if the voltage control circuit 201 according to the second embodiment of the present invention is used as a voltage regulator for a high voltage, no thermal damage occurs at the time of short-circuit, and the reliability of the product is enhanced.

The voltage control circuit according to the present invention can be applied not only to the power supply portion of a mobile device such as a cell phone but also to an in-vehicle regulator whose use environmental temperature is high or a large current regulator that allows a large current to flow.

What is claimed is:

1. A voltage control circuit, comprising:

a voltage control MOS transistor having an input terminal connected to a voltage input terminal and an output terminal connected to a voltage output terminal;

transistor control means for detecting a voltage value of an output voltage that is output from the voltage output terminal and controlling a voltage value of a control voltage that is applied to a control terminal of the voltage control MOS transistor so that the voltage value of the output voltage becomes a predetermined set voltage value;

a transistor control MOS transistor having an input terminal connected to the voltage input terminal and an output terminal connected to the control terminal of the voltage control MOS transistor, which applies an additional control voltage that increases conduction resistance of the voltage control MOS transistor to the control terminal of the voltage control MOS transistor when a voltage of the control terminal changes from a high potential to a low potential;

a monitor circuit having a monitor MOS transistor and a monitor resistor whose resistance is fixed which are connected in series, which is connected in parallel to the voltage control MOS transistor;

an inverter circuit having an input terminal input with a monitor voltage that is applied to the monitor resistor, and an output terminal whose voltage changes from a high potential to a low potential when the monitor voltage exceeds a predetermined threshold value; and a current mirror circuit including an input voltage conversion resistor that is electrically connected between the voltage input terminal and a ground potential, a second current mirror transistor that is connected in series with the input voltage conversion resistor and allows a current that flows in the input voltage conversion resistor to flow therein, and a first current mirror transistor that allows a current which flows in the second current mirror transistor to flow in the monitor resistor.

* * * * *